US011560902B2

(12) United States Patent
Wiyninger et al.

(10) Patent No.: US 11,560,902 B2
(45) Date of Patent: Jan. 24, 2023

(54) SELF-PRIMING ASSEMBLY FOR USE IN A MULTI-STAGE PUMP

(71) Applicant: Pentair Flow Technologies, LLC, Delavan, WI (US)

(72) Inventors: Bradley Wiyninger, Delano, MN (US); Daniel Allan Beilke, Blaine, MN (US); Jeff Hermes, Shoreview, MN (US); Eli McElwain, Andover, MN (US)

(73) Assignee: PENTAIR FLOW TECHNOLOGIES, LLC, Delavan, WI (US)

( * ) Notice: Subject to any disclaimer, the term of this patent is extended or adjusted under 35 U.S.C. 154(b) by 0 days.

(21) Appl. No.: 16/773,110

(22) Filed: Jan. 27, 2020

(65) Prior Publication Data

US 2020/0240434 A1 Jul. 30, 2020

Related U.S. Application Data

(60) Provisional application No. 62/796,743, filed on Jan. 25, 2019.

(51) Int. Cl.

| | |
|---|---|
| ***F04D 9/02*** | (2006.01) |
| ***F04D 29/44*** | (2006.01) |
| ***F04D 1/06*** | (2006.01) |
| ***F04D 29/22*** | (2006.01) |

(52) U.S. Cl.

CPC ..... *F04D 29/445* (2013.01); *F04D 1/06* (2013.01); *F04D 9/02* (2013.01); *F04D 29/22* (2013.01)

(58) Field of Classification Search

CPC . F04D 1/06; F04D 1/066; F04D 5/002; F04D 9/02; F04D 29/22; F04D 29/44; F04D 29/445

See application file for complete search history.

(56) References Cited

U.S. PATENT DOCUMENTS

| | | | |
|---|---|---|---|
| 1,682,331 | A | 8/1928 | Goyne et al. |
| 1,920,484 | A | 8/1933 | Slemon et al. |
| 1,971,441 | A | 8/1934 | Broadhurst |
| 2,006,590 | A | 7/1935 | Ferguson |
| 2,386,275 | A | 10/1945 | Sigmund et al. |
| 2,430,509 | A | 11/1947 | Hoover |

(Continued)

FOREIGN PATENT DOCUMENTS

| | | |
|---|---|---|
| DE | 888207 C | 8/1953 |
| DE | 102005060895 A1 | 6/2007 |

(Continued)

OTHER PUBLICATIONS

Extended European Search Report, European Application No. 20153820.4, dated May 19, 2020, 7 pages.

(Continued)

*Primary Examiner* — Brian P Wolcott
(74) *Attorney, Agent, or Firm* — Husch Blackwell LLP

(57) ABSTRACT

A self-priming assembly for a multi-stage pump is provided. The self-priming assembly can have a first diffuser, a second diffuser, and an impeller. The first and second diffusers each include a central portion, a diffuser axis, an arcuate channel within the central portion, and a passage extending through the central portion. The first diffuser and the second diffuser are configured to be combined and receive the impeller therebetween with the first diffuser axis, the second diffuser axis, and the impeller axis aligned.

19 Claims, 6 Drawing Sheets

(56) References Cited

U.S. PATENT DOCUMENTS

| | | | | |
|---|---|---|---|---|
| 2,553,066 | A | 5/1951 | Southern | |
| 2,674,189 | A | 4/1954 | Lung | |
| 2,696,789 | A | 12/1954 | Fabig | |
| 2,790,393 | A | 4/1957 | Hill et al. | |
| 2,810,350 | A | 10/1957 | Macwilliams | |
| 2,841,088 | A | 7/1958 | Daddario | |
| 3,007,417 | A | 11/1961 | James | |
| 3,050,008 | A | 8/1962 | Paccy et al. | |
| 3,082,694 | A | 3/1963 | Brkich | |
| 3,093,085 | A | 6/1963 | Pollak | |
| 3,151,566 | A | 10/1964 | Durstberger | |
| 3,188,974 | A | 6/1965 | Rosaen | |
| 3,230,890 | A | 1/1966 | Yokota et al. | |
| 3,336,876 | A | 8/1967 | Streuli | |
| 3,644,061 | A | 2/1972 | McFarlin | |
| 3,867,070 | A | 2/1975 | Sloan | |
| 4,035,104 | A | 7/1977 | Buse | |
| 4,067,665 | A | 1/1978 | Schwartzman | |
| 4,256,436 | A | 3/1981 | Fandrey et al. | |
| 4,390,317 | A | 6/1983 | Lehmann et al. | |
| 4,493,607 | A | 1/1985 | Napolitano | |
| 4,726,734 | A | 2/1988 | Zientek et al. | |
| 4,780,050 | A | 10/1988 | Caine et al. | |
| 4,804,313 | A | 2/1989 | Nasvytis | |
| 5,035,583 | A | 7/1991 | Vaught | |
| 5,378,125 | A | 1/1995 | Frank et al. | |
| 5,401,147 | A | 3/1995 | Yu | |
| 5,536,147 | A | 7/1996 | Lang | |
| 5,596,970 | A | 1/1997 | Schoenberg et al. | |
| 5,785,501 | A | 7/1998 | Van Coillie et al. | |
| 6,071,072 | A * | 6/2000 | Chang | F04D 9/007 415/56.2 |
| 6,152,689 | A | 11/2000 | Yokota et al. | |
| 6,315,524 | B1 | 11/2001 | Muhs et al. | |
| 6,336,788 | B1 | 1/2002 | Fujii et al. | |
| 6,409,478 | B1 | 6/2002 | Carnes et al. | |
| 6,575,706 | B2 | 6/2003 | Carnes et al. | |
| 6,585,492 | B2 | 7/2003 | Muhs et al. | |
| 6,616,427 | B2 | 9/2003 | Carnes et al. | |
| 6,692,234 | B2 | 2/2004 | Muhs | |
| 6,837,692 | B2 | 1/2005 | Martinello | |
| 6,926,492 | B2 | 8/2005 | Hegebarth | |
| 7,011,505 | B2 | 3/2006 | Muhs | |
| 7,059,824 | B2 | 6/2006 | Ramacciotti | |
| 7,165,932 | B2 | 1/2007 | Yu et al. | |
| RE39,813 | E | 9/2007 | Carnes et al. | |
| 7,331,769 | B2 | 2/2008 | Weis et al. | |
| 7,520,720 | B2 | 4/2009 | Welch | |
| 7,748,949 | B2 | 7/2010 | Wattai et al. | |
| 3,172,549 | A1 | 5/2012 | Jensen | |
| 8,206,126 | B2 | 6/2012 | Wattai et al. | |
| 8,246,316 | B2 | 8/2012 | Muhs | |
| 8,662,862 | B2 | 3/2014 | Muhs | |
| 9,453,511 | B2 * | 9/2016 | Quail | F04D 13/10 |
| 9,879,680 | B2 * | 1/2018 | Mikkelsen | F04D 1/063 |
| 10,180,141 | B2 | 1/2019 | Huang | |
| 10,337,516 | B2 * | 7/2019 | Vinther Toft | F04D 1/10 |
| 2004/0120828 | A1 | 6/2004 | Muhs | |
| 2005/0191185 | A1 | 9/2005 | Jones et al. | |
| 2011/0280714 | A1 | 11/2011 | Northrup et al. | |
| 2013/0058757 | A1 | 3/2013 | Johnson | |
| 2013/0183168 | A1 | 7/2013 | Horley et al. | |
| 2020/0309135 | A1 | 10/2020 | Kirk | |
| 2021/0310490 | A1 | 10/2021 | Hohn et al. | |

FOREIGN PATENT DOCUMENTS

| | | | |
|---|---|---|---|
| EP | 2420677 | A1 | 2/2012 |
| FR | 911196 | A | 7/1946 |
| GB | 621691 | A | 4/1949 |
| GB | 691513 | A | 5/1953 |
| GB | 776635 | A | 6/1957 |
| JP | 2015140701 | A * | 8/2015 |
| JP | 2015140701 | A | 8/2015 |
| JP | 6229514 | B2 | 11/2017 |
| KR | 20000066454 | A | 11/2000 |
| KR | 100951430 | B1 * | 4/2010 |
| KR | 20110057775 | A | 6/2011 |
| KR | 101711106 | B1 | 2/2017 |
| WO | 2011065737 | A2 | 6/2011 |
| WO | 2019/079070 | | 4/2019 |
| WO | 2021/202090 | | 10/2021 |

OTHER PUBLICATIONS

Examination Report issued for European Patent Application No. 20153820.4 dated Mar. 3, 2022, 6 pages.

* cited by examiner

SELF-PRIMING ASSEMBLY FOR USE IN A MULTI-STAGE PUMP

RELATED APPLICATIONS

This application claims priority under 35 U.S.C. § 119 to U.S. Provisional Application No. 62/796,743 filed on Jan. 25, 2019, the entire disclosure of which is incorporated herein by reference.

BACKGROUND

In many fluid pumping applications it may be useful to have a self-priming multi-stage pump. Present approaches to priming a multi-stage pump incorporate secondary equipment. For instance, a separate diaphragm pump or a compressed air powered venturi/vacuum pump can be employed to prime the multi-stage pump. However, these types of systems not only require additional components, but can be costly and complex. Therefore, a self-priming pump that engages in the pumping action when called upon without requiring extensive secondary equipment or intervention by an operator to prime the pump is a more efficient approach to establishing prime and engaging the pumping action.

SUMMARY

The invention relates to multi-stage pumps and methods. Specifically, the invention relates to a self-priming assembly for use in multi-stage pumps.

Some of the embodiments provide a self-priming assembly for a multi-stage pump. The self-priming assembly can have a first diffuser with a first central portion, a first diffuser axis, a first arcuate channel within the first central portion, and a first arcuate passage extending through the first central portion. The first arcuate channel and the first arcuate passage are concentric with each other about the first diffuser axis. Additionally, a second diffuser with a second central portion, a second diffuser axis, a second arcuate channel within the second central portion, and a second arcuate passage extending through the second central portion can be included. The second arcuate channel and the second arcuate passage are concentric with each other about the second diffuser axis. An impeller with a plurality of chambers radially spaced around a hub and an impeller axis is also included. The first diffuser and the second diffuser are configured to be combined and receive the impeller therebetween with the first diffuser axis, the second diffuser axis, and the impeller axis aligned.

Some embodiments include a self-priming assembly in which the first diffuser and the second diffuser are substantially identical. Other embodiments provide that the impeller has an axle and the first diffuser and the second diffuser each have a through-hole configured to receive the axle. Still other embodiments provide that the first arcuate passage o can be located between the first arcuate channel and the first diffuser axis, and that the second arcuate passage can be located between the second arcuate channel and the second diffuser axis. Some embodiments provide that the first arcuate channel can extend around the first diffuser axis approximately $5\pi/3$ radians (300 degrees) and the second arcuate channel can extend around the second diffuser axis approximately $5\pi/3$ radians (300 degrees). Some embodiments provide that the first arcuate passage can extend around the first diffuser axis approximately $2\pi/3$ radians (120 degrees) and the second arcuate passage can extend around the second diffuser axis approximately $2\pi/3$ radians (120 degrees).

Other embodiments provide a self-priming assembly wherein the first arcuate channel and the second arcuate channel each have a depth dimension, a width dimension, a first portion, a second portion, and a third portion, wherein each of the depth dimension and the width dimension is greater in the second portion than in the first and third portions. The depth dimension and the width dimension of the first arcuate channel and the second arcuate channel can gradually increase from the first portion to the second portion and can gradually decrease from the second portion to the third portion. Additionally, the first arcuate channel has a first length and the first arcuate passage can extend laterally along the first arcuate channel for less than a majority of the first length of the first arcuate channel, and the second arcuate channel has a second length and the second arcuate can extend laterally along the second arcuate channel for less than a majority of the length of the second arcuate channel.

Other embodiments provide a self-priming assembly in which the plurality of chambers in the impeller is wedge-shaped. Further, each chamber of the plurality of chambers can extend around the impeller axis approximately $\pi/6$ radians (30 degrees).

Another embodiment includes a multi-stage pump with an input member, an output member, a plurality of pump stage assemblies assembled along a pump axis, and a self-priming assembly with a first diffuser with a first diffuser axis, a second diffuser with a second diffuser axis configured to interface with the first diffuser, and an impeller with an impeller axis positioned between the first diffuser and the second diffuser and axially aligned with the first diffuser axis and the second diffuser axis. The self-priming assembly can be attached to the plurality of pump stage assemblies and axially aligned with the pump axis, and the plurality of pump stage assemblies and the self-priming assembly can be positioned between the input member and the output member. Other embodiments can be arranged in which the self-priming assembly is positioned adjacent to the output member.

Other embodiments of the invention can provide that the first diffuser and the second diffuser are identical, each with an arcuate channel and an arcuate passage concentric therewith. The arcuate channels of the first and second diffusers can have a length dimension and the arcuate passages can extend laterally along the arcuate channels for less than a majority of the length dimension. Further, the arcuate channels can have a depth dimension and a width dimension that change over the length dimension. In other embodiments, the arcuate channels can have a first portion, a second portion, and a third portion, and the depth dimension and the width dimension increase from the first portion to the second portion and decrease from the second portion to the third portion.

Other embodiments include an impeller having a hub and a plurality of chambers extending outward from the hub. Additionally, the plurality of chambers can be substantially equally sized and wedge-shaped. Further, each chamber of the plurality of chambers can extend around the impeller axis approximately $\pi/6$ radians (30 degrees).

These and other features of the disclosure will become more apparent from the following description of the illustrative embodiments.

Figure 1:
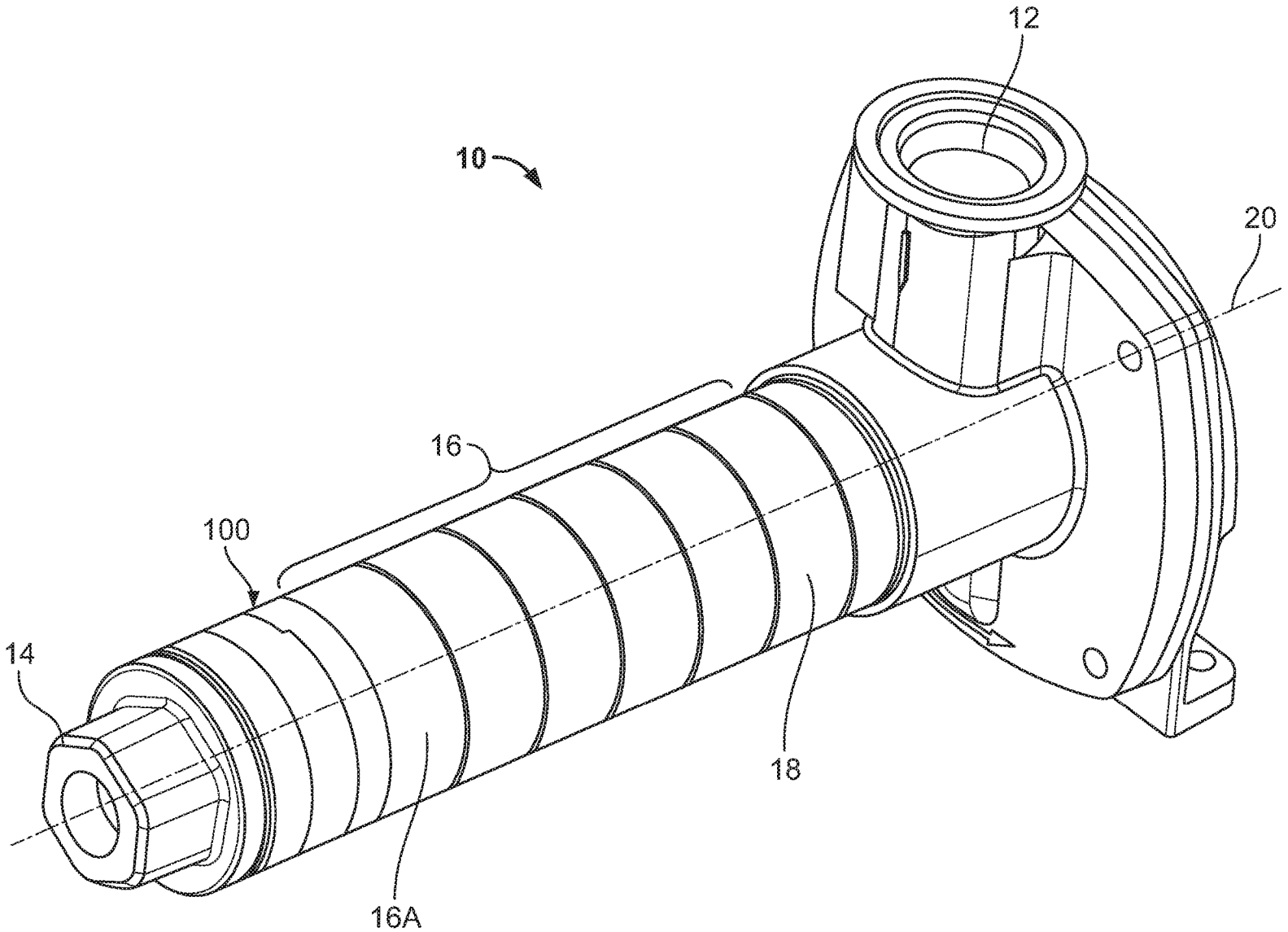
FIG. 1 is an isometric view of a multi-stage pump with a cover removed therefrom and exposing multiple pump stage assemblies and a self-priming assembly integrated therewith according to one embodiment.

Corresponding reference characters indicate corresponding parts throughout the several views. Although the drawings represent embodiments of the disclosure, the drawings are not necessarily to scale and certain features may be exaggerated in order to better illustrate and explain the embodiments of the disclosure.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

The following discussion is presented to enable a person skilled in the art to make and use embodiments of the invention. Various modifications to the illustrated embodiments will be readily apparent to those skilled in the art, and the generic principles herein can be applied to other embodiments and applications without departing from embodiments of the invention. Thus, embodiments of the invention are not intended to be limited to embodiments shown, but are to be accorded the widest scope consistent with the principles and features disclosed herein. The following detailed description is to be read with reference to the figures, in which like elements in different figures have like reference numerals. The figures, which are not necessarily to scale, depict selected embodiments and are not intended to limit the scope of embodiments of the invention. Skilled artisans will recognize the examples provided herein have many useful alternatives and fall within the scope of embodiments of the invention.

Some of the disclosure below describes a multi-stage pump with a self-priming assembly configured to prime the multi-stage pump upon activation of the multi-stage pump. The context and particulars of this discussion are presented as examples only. For example, embodiments of the disclosed invention can be configured in various ways, including different placement and more, fewer, and/or different parts within the multi-stage pump than are expressly presented below, such as a self-priming assembly positioned at any location among the plurality of pump stage assemblies, including before, after, or in-between. As another example, the self-priming assembly can be combined with one or multiple pump stage assemblies. As a further example, a plurality of self-priming assemblies can be incorporated within a multi-stage pump.

FIG. 1 illustrates an example multi-stage pump 10 incorporating an embodiment of a self-priming assembly 100 according to one embodiment of the invention. The multi-stage pump 10 includes an inlet member 12, an outlet member 14, and a plurality of pump stage assemblies 16 provided therebeteween. The plurality of pump stage assemblies 16 each generally contain an impeller and a diffuser assembly 18 that are axially aligned along a pump axis 20. Each of the plurality of pump stage assemblies 16 is configured to direct a fluid to the outermost portion of the diffuser 18 through the rotation of the impeller and the inertia of the fluid. Pressure within the multi-stage pump 10 progressively increases as the fluid travels through the plurality of pump stage assemblies 16 from the inlet member 12 to the outlet member 14.

As shown in FIG. 1, the self-priming assembly 100 is positioned between the ultimate (i.e., final or last) pump stage assembly 16A of the plurality of pump stage assemblies 16 and the outlet member 14 and is axially aligned with the plurality of pump stage assemblies 16 along the pump axis 20. However, as stated previously, in other embodiments the self-priming assembly 100 can also be positioned between the inlet member 12 and the plurality of pump stage assemblies 16 or in-between any two pump stage assemblies 16. In still other embodiments, multiple self-priming assemblies 100 can be incorporated and positioned at various locations throughout the multistage pump 10 (e.g., one positioned closest to the inlet member 12 and another positioned closest to the outlet member 14, two or more adjacent to the others and positioned at any stage position within the multi-stage pump 10, etc.).

Figure 2:
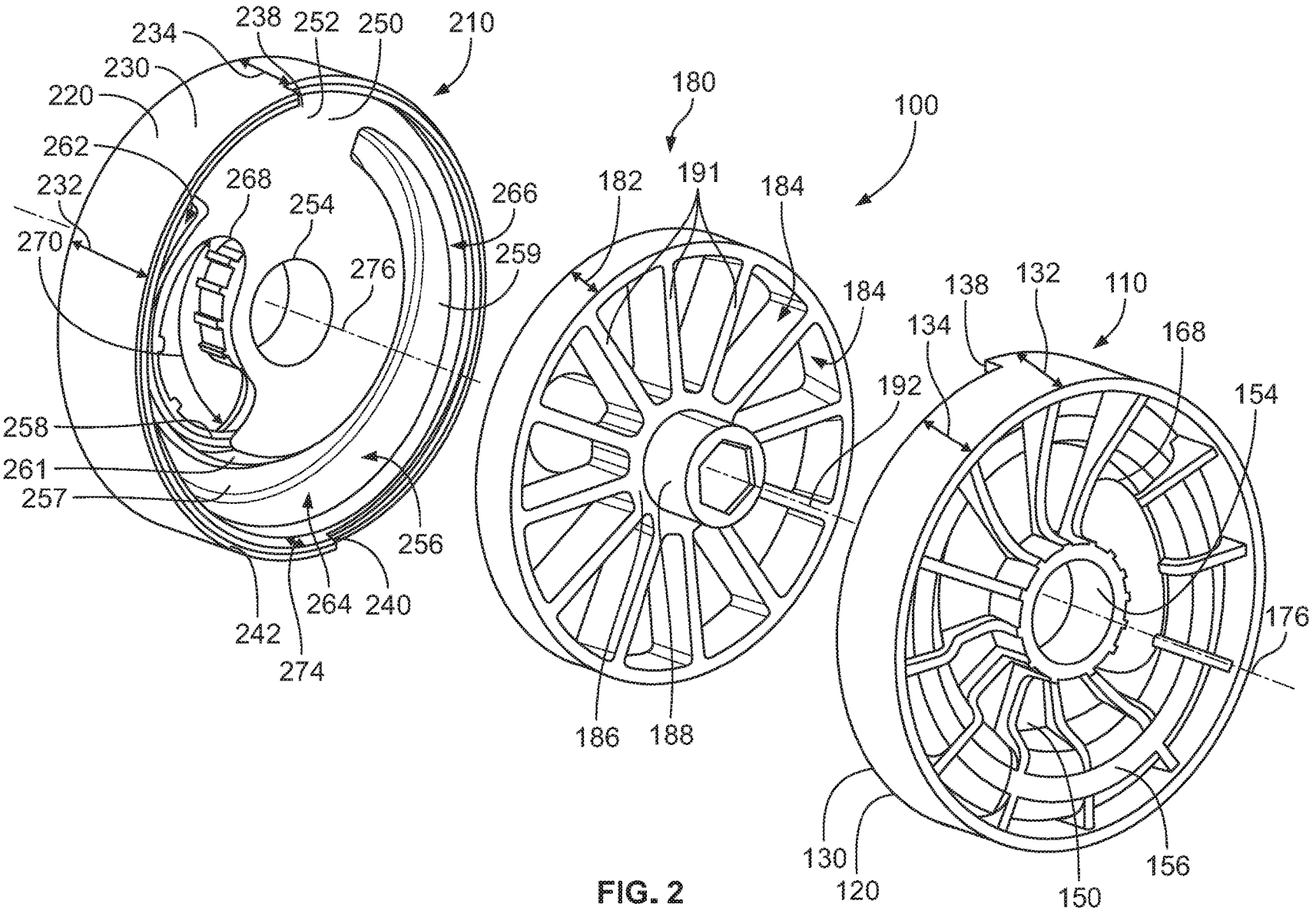
FIG. 2 is a front isometric exploded view of the self-priming assembly of the multi-stage pump shown in FIG. 1.
Figure 3:
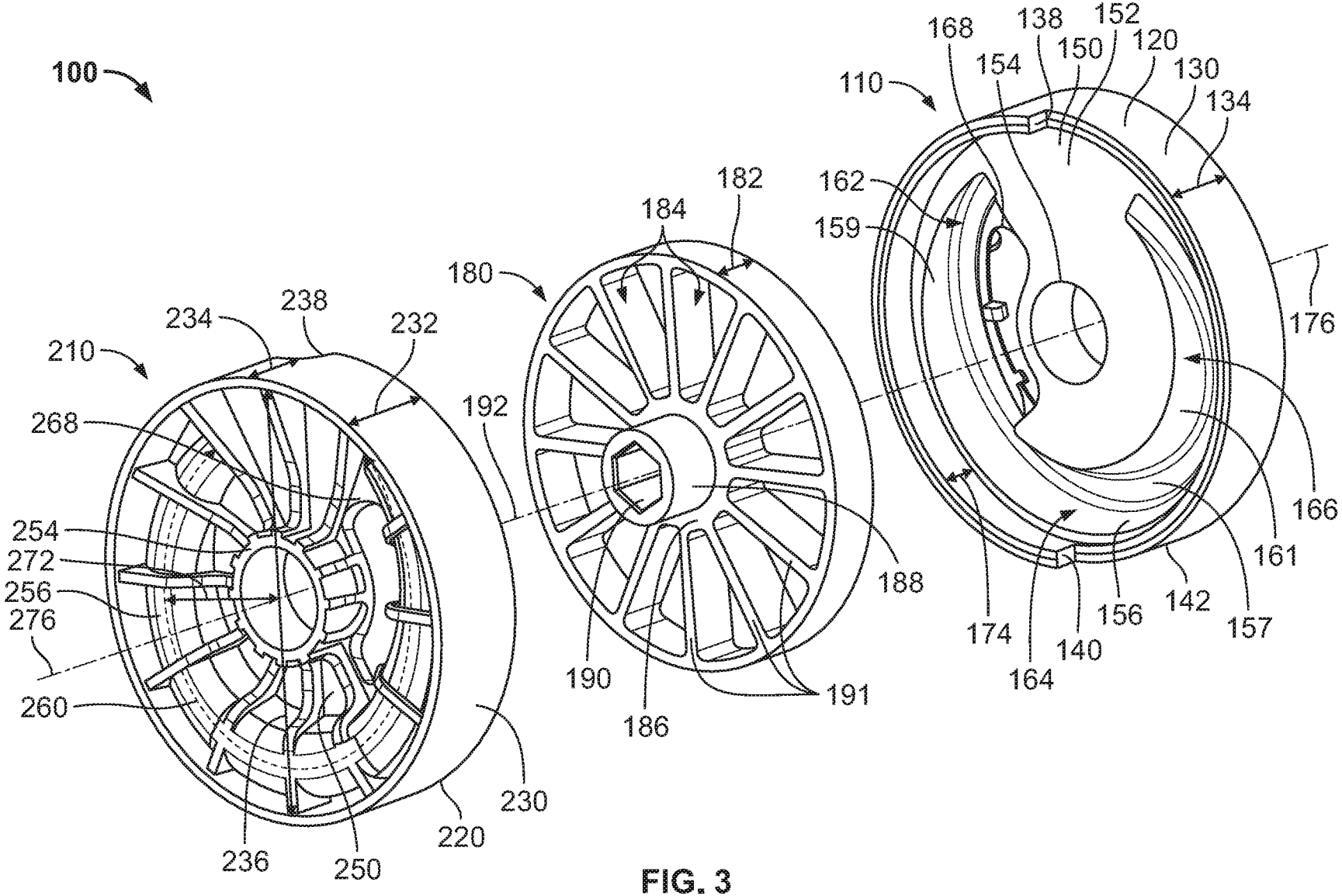
FIG. 3 is a rear isometric exploded view of the self-priming assembly of the multi-stage pump shown in FIG. 1.

Turning now to FIGS. 2 and 3, the self-priming assembly 100 is shown in exploded form from various angles. The self-priming assembly 100 includes a first diffuser 110, a second diffuser 210, and an impeller 180 positioned between and within the first and second diffusers 110, 210. The first diffuser 110 and the second diffuser 210 can be substantially similar in every regard, including shape, size, and configuration, wherein like reference numbers represent like elements. This relationship not only simplifies the manufacturing process but also aids in assembly and functionality.

Figure 4:
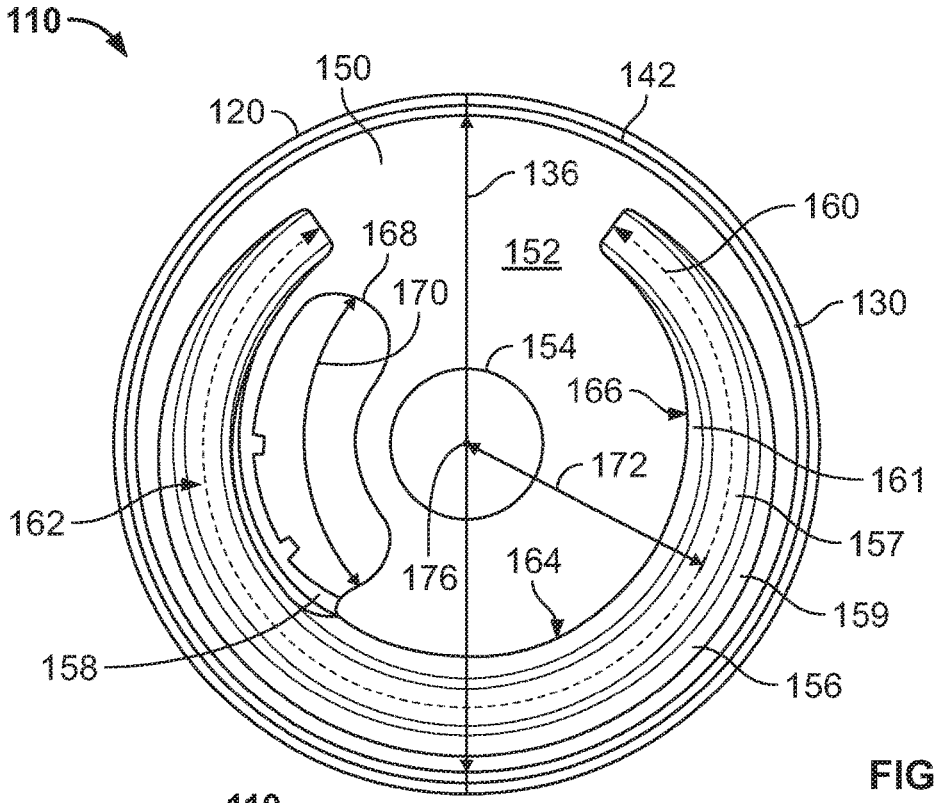
FIG. 4 is a front elevational view of a diffuser plate of the multi-stage pump of FIG. 1 according to one embodiment.
Figure 5:
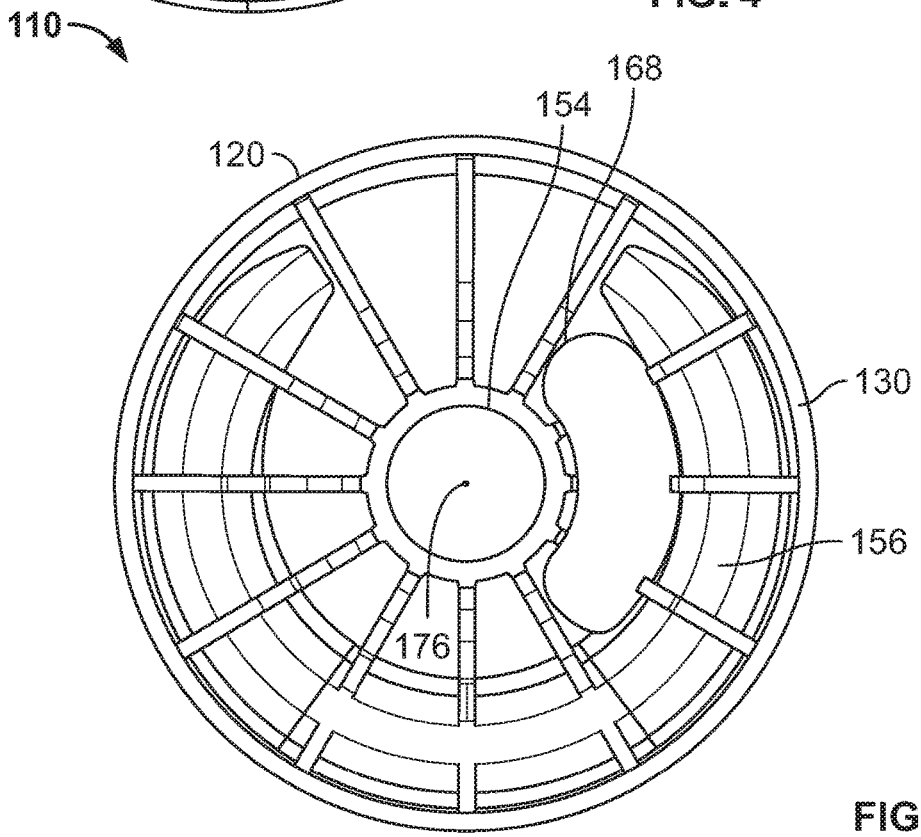
FIG. 5 is a rear elevational view of the diffuser plate shown in FIG. 4.

With further reference to FIGS. 4 and 5, the first diffuser 110 is shown. As stated above, the second diffuser 210 is substantially similar to the first diffuser 110; therefore, for the sake of brevity the first and second diffusers 110, 210 will be described together.

The first and second diffusers 110, 210 are defined by bodies 120, 220 that are substantially disc-shaped with a depth that extends along first and second diffuser axes 176. 276. Each of the bodies 120, 220 have a peripheral portion 130, 230 and a central portion 150, 250. The peripheral portions 130, 230 extend along and define the circumference of the bodies 120, 220 and have a first width 132, 232 for half of the circumference, a second width 134, 234 for the remaining half of the circumference, and an inner diameter 136, 236. The first width dimensions 132, 232 are each greater than the second width dimensions 134, 234, respectively, whereby the difference defines a first ledge 138, 238 and a second ledge 140, 240 along mating surfaces 142, 242.

The central portions 150, 250 are adjacent to and bounded by the peripheral portions 130, 230 and have a central portion surface 152, 252 defining a central portion plane that is substantially perpendicular to the first and second diffuser axes 176, 276. The central portion surfaces 152, 252 are positioned inwards from the mating surface 142, 242 along the first and second diffuser axes 176, 276 a distance 174, 274 from the internal mating surface 142, 242 at the portion of the peripheral portion 130, 230 with the first width dimensions 132, 232. Further, through-holes 154, 254 are provided in the central portions 150, 250 and centered on the first and second diffuser axes 176, 276.

An arcuate channel 156, 256 is provided in the central portions 150, 250 between the through-hole 154, 254 and the peripheral portion 130, 230 and is substantially concentric, or concentric with both. The channels 156, 256 extend approximately $5\pi/3$ radians, or approximately 300 degrees, around the central portion surfaces 152, 252 and define channel lengths 160, 260 at a radial distances 172, 272 from the first and second diffuser axes 176, 276.

The channels 156, 256 are continuous along the channel lengths 160, 260 and have a first portion 162, 262 adjacent to a second portion 164, 264, which is adjacent to a third portion 166 266. The channels 156, 256 each have a first depth dimension and a first width dimension at the first portion 162, 262, which both increase in depth and width as the channels 156, 256 extend from the first portion 162, 272 to the second portion 164, 264. The channels 156, 256 include a planar base surface 157, 257 with flared sidewalls 159, 259 and 161, 261 that extend away from the base surface 157, 257 in radially outer and inner directions respectively. The second depth dimension and second width dimension of the channels 156, 256 are maintained through the second portion 164, 264. The depth dimension and the width dimension of the channels 156, 256 gradually decrease back to approximately the first depth dimension and the first width dimension as the channels 156, 256 extend from the second portion 164, 264 the third portion 166, 266. While the example channels 156, 256 are illustrated with generally planar surfaces having linear or constant curvatures, the channels 156, 256 may define a variety of other form factors to impart application-specific flow dynamics.

The passages 168, 268 are defined by an arcuate ellipse-like shape and extend through the central portion 150, 250. The passages 168, 268 are radially spaced between the first portion 162, 262 of the channels 156, 256 and the through-holes 154, 254, and are substantially concentric with both. The passages 168, 268 each extend along the central portions 150, 250 for approximately the same radians as the first portion 162, 262 of the channels 156, 256 (e.g., approximately $2\pi/3$ radians or 120 degrees), and define a passage length 170, 270. At transitions 158, 258, the radially inner sidewalls 161, 261 transition toward the base surface 157, 257 and into the passage 168, 268 proximate the first portion 162, 262 of the channel 156, 256.

Figure 6:
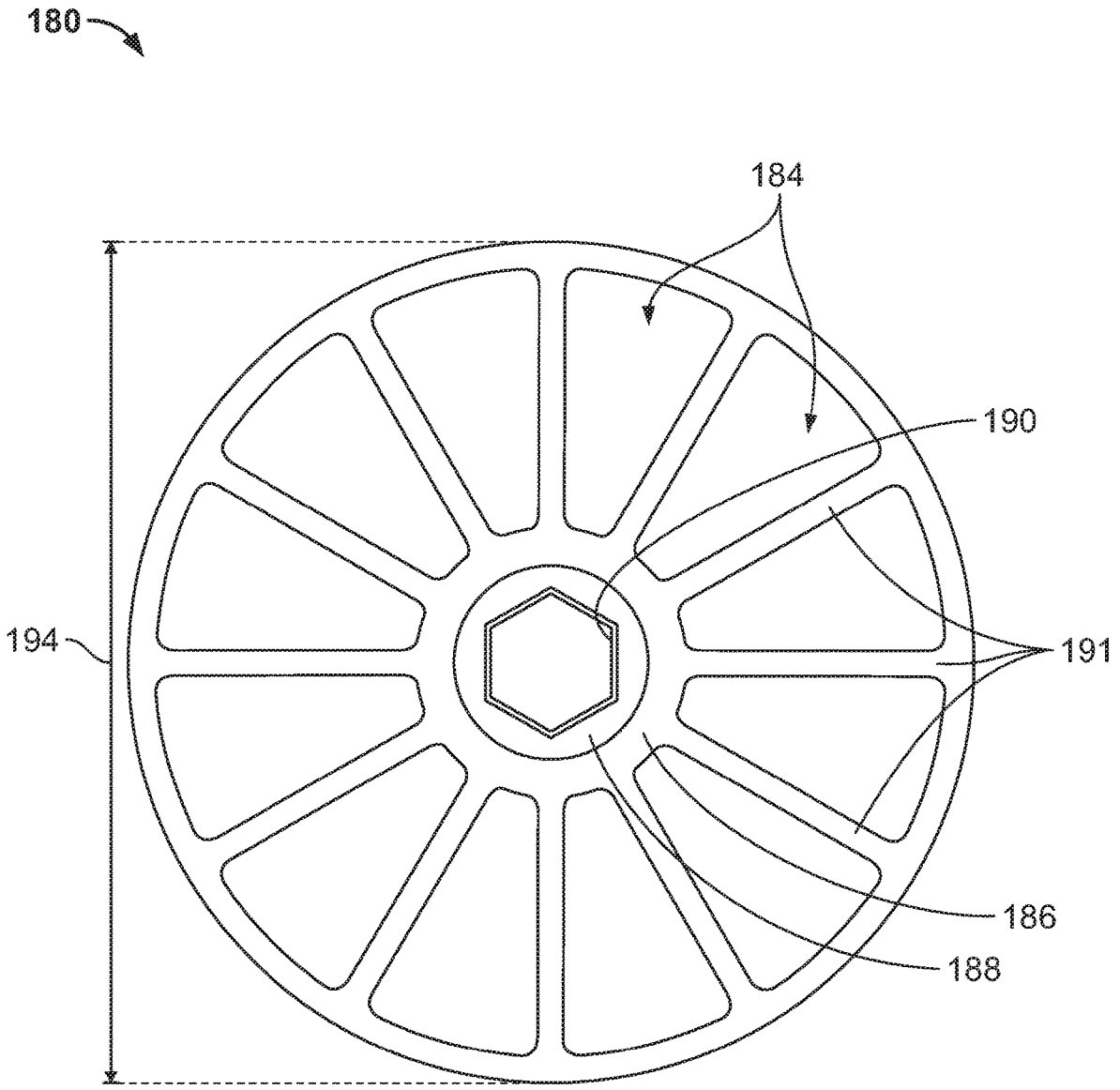
FIG. 6 is a front elevational view of an impeller of the multi-stage pump of FIG. 1, according to one embodiment.

The impeller 180 is shown in FIGS. 2, 3, and 6. The impeller 180 is defined by an impeller body having an impeller depth 182, an impeller diameter 194, and a plurality of chambers 184 extending radially outward from and radially spaced around a hub 186. The hub 186 has an axle 188 extending axially outwardly from the hub 186 along an impeller axis 192. The axle 188 is configured to be received within the through-holes 154, 254 of the first and second diffusers 110, 210, respectively, when the self-priming assembly 10 is assembled.

Figure 7:
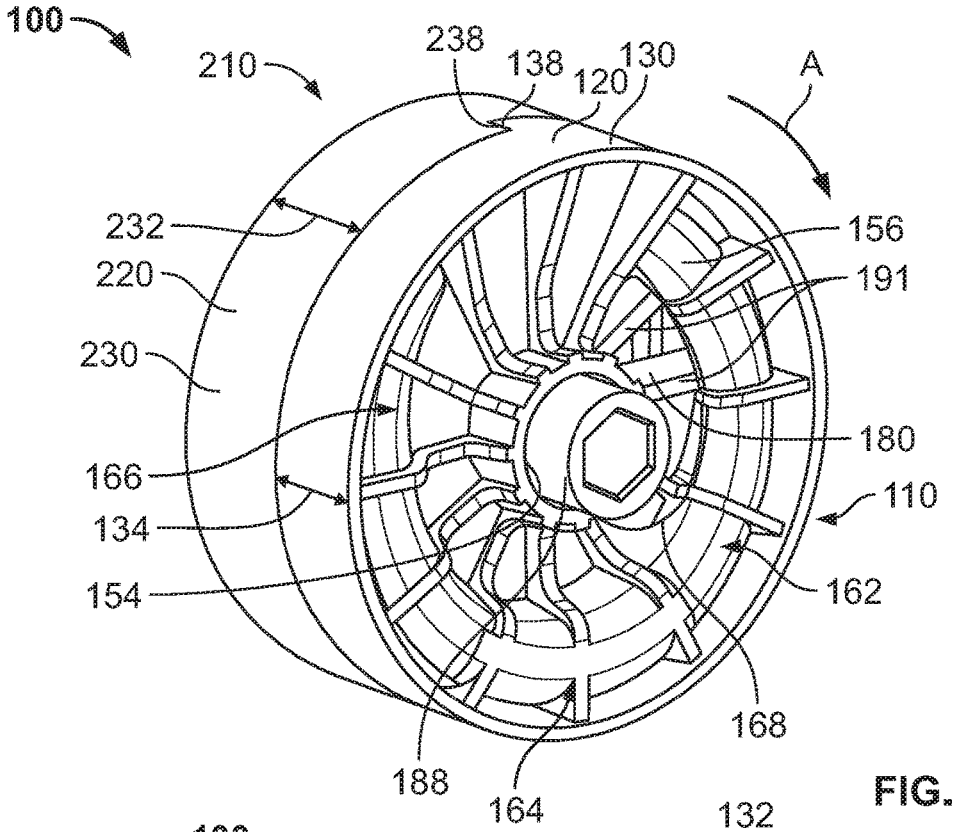
FIG. 7 is a front isometric view of the self-priming assembly of the multi-stage pump shown in FIG. 1.
Figure 8:
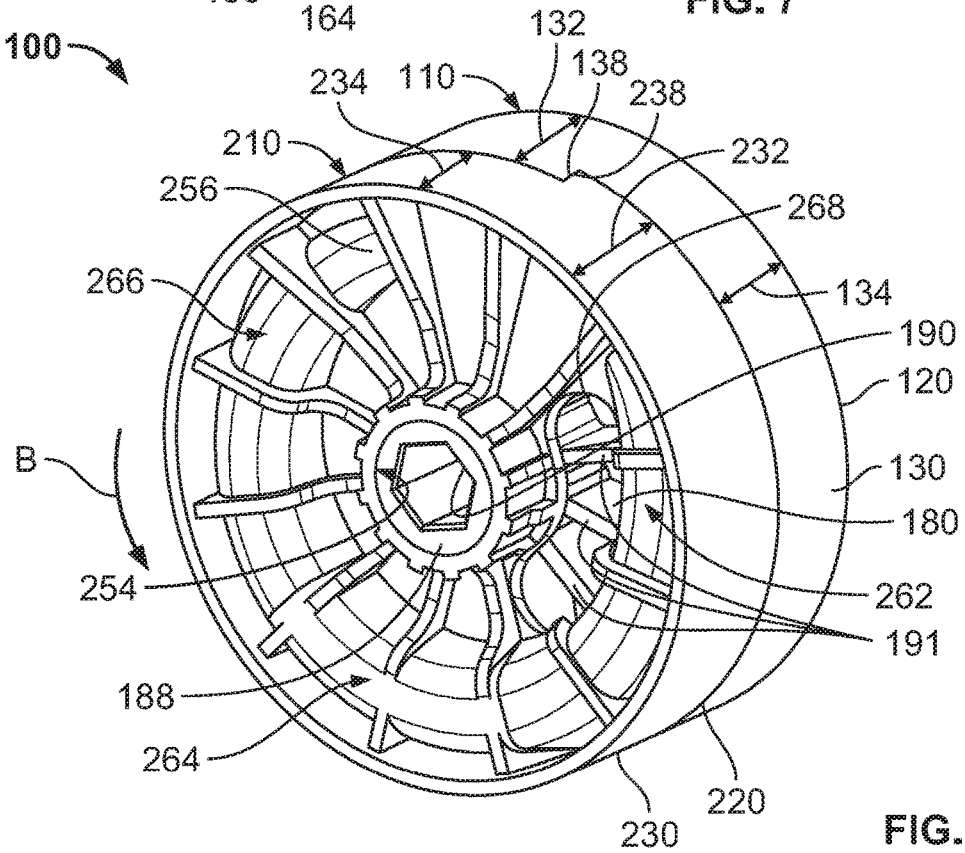
FIG. 8 is a rear isometric view of the self-priming assembly of the multi-stage pump shown in FIG. 1.

The impeller depth 182 is substantially similar to and preferably slightly less than an axial distance defined between the central portions 150, 250 when the respective first and second diffusers 110, 210 are coupled (shown in FIGS. 7 and 8). The impeller diameter 194 is preferably slightly less than the inner diameters 136, 236 of the peripheral portions 130, 230 of the first and second diffusers 110, 210. The impeller 180 is configured to be retained within and between the first and second diffusers 110, 210.

The plurality of chambers 184 is wedge-shaped and is radially spaced around the hub 186. The axle 188 has an aperture 190 sized and configured to receive a drive shaft of the multi-stage pump 10. The plurality of chambers 184 are equally sized, with each chamber having an angular measurement of approximately $\pi/6$ radians, or 30 degrees. A plurality of planar spokes 191 extend radially outward from the hub 186. In other forms, the spokes 191 can define arcuate blades of varying cross-section and orientation to accommodate application-specific pumping performance.

In use, when the multi-stage pump 10 is activated, the impeller 180 rotates due to the engagement between the driveshaft of the multi-stage pump 10 and the axle 188 of the impeller 180. As shown in FIG. 7 the rotation of the impeller 180 is clockwise in the direction of arrow A and in FIG. 8 the impeller 180 is viewed as rotating counter-clockwise in the direction of arrow B. Fluid generally moves through the multi-stage pump 10 into the passage 168 in the first diffuser 110 and into at least one of the plurality of chambers 184 in the impeller 180. Because the first diffuser 110 and the second diffuser 210 are identical, when they are coupled together, as shown in FIGS. 7 and 8, the first portion 162 of the first diffuser 110 aligns with the third portion 266 of the second diffuser 210. Similarly, the third portion 166 of the first diffuser 110 aligns with the first portion 262 of the second diffuser 210. Accordingly, when fluid enters the self-priming assembly 100 through the passage 168, the fluid subsequently flows into the first portion 162 of the first diffuser 110 and the third portion 266 of the second diffuser 210. The rotation of the impeller 180 urges the fluid to the outermost portion of the plurality of chambers 184 and into the channels 156, 256 of the first and second diffusers 110, 210.

The movement of fluid from the passage 168 in the first diffuser 110 to the outermost portion of the plurality of chambers 184 creates a low pressure to urge more fluid into the self-priming assembly 100. This action causes the fluid to displace the air in the pump cavity and carry the air along with the fluid, which creates a vacuum. The fluid then travels along the second portions 164, 264 of the channels 156, 256 which comprise the deepest portions of channels 156, 256 and where the fluid is inhibited from entering or exiting the channels 156, 256. Through continued rotation of the impeller 180, the fluid then enters the third portion 166 of channel 156 and the first portion 262 of channel 256, which are each more shallow in depth than the respective second portion 164, 264. As discussed above, the first portion 262 of channel 256 is where the transition 258 is located and the radially inner sidewall 261 tapers toward the passage 268. Thus, fluid is directed toward and out of the passage 268 of the second diffuser 210, and eventually out of the outlet member 14 of the multi-stage pump 10.

When assembled, the first and second ledges 138, 140 of the first diffuser 110 abut the first and second ledges 238, 240 of the second diffuser 210, respectively. During use, this arrangement prevents the first and second diffusers 110, 210 from rotating relative to each other as the self-priming assembly 100 experiences torque created by the rotation of the impeller 180 and movement of fluid through the self-priming assembly 100. Various alternative interlocking arrangements can be employed to rotationally couple the first and second diffusers 110, 210, such as external tabs that mate with a fixed external collar or housing.

It is preferable that at least the self-priming assembly 100 contains fluid upon activation of the multi-stage pump 10 (e.g., such as via an elbow or trap in fluid communication with the outlet member 14). Fluid in the plurality of chambers 184 aids in creating and maintaining a vacuum within the self-priming assembly 100 when the impeller 180 is initially rotated. The vacuum draws fluid through the plurality of pump stage assemblies 16 of the multi-stage pump 10 toward and through the self-priming assembly 100 and out the outlet member 14.

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the claims attached hereto. The entire disclosure of each patent and publication cited herein is incorporated by reference, as if each such patent or publication were individually incorporated by reference herein. Various features and advantages of the invention are set forth in the following claims.

The invention claimed is:

1. A self-priming assembly for a multi-stage pump, the self-priming assembly comprising:

a first diffuser with a first central portion, a first diffuser axis, a first arcuate channel within the first central portion, and a first arcuate passage extending through the first central portion, wherein the first arcuate channel and the first arcuate passage are concentric with each other about the first diffuser axis;

a second diffuser with a second central portion, a second diffuser axis, a second arcuate channel within the second central portion, and a second arcuate passage extending through the second central portion, wherein the second arcuate channel and the second arcuate passage are concentric with each other about the second diffuser axis, and wherein the first arcuate channel and the second arcuate channel each have a depth dimension, a width dimension, a first portion, a second portion, and a third portion, wherein each of the depth dimension and the width dimension is greater in the second portion than in the first portion and the third portion; and an impeller with a plurality of chambers radially spaced around a hub and an impeller axis;

wherein the first diffuser and the second diffuser are configured to be combined and receive the impeller therebetween with the first diffuser axis, the second diffuser axis, and the impeller axis aligned.

2. The self-priming assembly of claim 1, wherein the first diffuser and the second diffuser are substantially identical.

3. The self-priming assembly of claim 1, wherein the impeller has an axle and the first diffuser and the second diffuser each have a through-hole configured to receive the axle.

4. The self-priming assembly of claim 1, wherein the first arcuate passage is located between the first arcuate channel and the first diffuser axis, and the second arcuate passage is located between the second arcuate channel and the second diffuser axis.

5. The self-priming assembly of claim 1, wherein the first arcuate channel extends around the first diffuser axis approximately $5\pi/3$ radians, and the second arcuate channel extends around the second diffuser axis approximately $5\pi/3$ radians.

6. The self-priming assembly of claim 1, wherein the first arcuate passage extends around the first diffuser axis approximately $2\pi/3$ radians, and the second arcuate passage extends around the second diffuser axis approximately $2\pi/3$ radians.

7. The self-priming assembly of claim 1, wherein the depth dimension and the width dimension of the first arcuate channel and the second arcuate channel gradually increases from the first portion to the second portion and gradually decreases from the second portion to the third portion.

8. The self-priming assembly of claim 1, wherein the first arcuate channel has a first length and the first arcuate passage extends laterally along the first arcuate channel for less than a majority of the first length, and the second arcuate channel has a second length and the second arcuate passage extends laterally along the second arcuate channel for less than a majority of the second length.

9. The self-priming assembly of claim 1, wherein the plurality of chambers in the impeller are wedge-shaped.

10. The self-priming assembly of claim 9, wherein each chamber of the plurality of chambers extends around the impeller axis approximately it/6 radians.

11. A multi-stage pump comprising:

an input member;

an output member;

a plurality of pump stage assemblies assembled along a pump axis; and a self-priming assembly having:

a first diffuser with a first diffuser axis, the first diffuser including a first central portion, a first arcuate channel within the first central portion, and a first arcuate passage extending through the first central portion, wherein the first arcuate channel has a depth dimension, a width dimension, a first portion, a second portion, and a third portion, wherein each of the depth dimension and the width dimension is greater in the second portion than in the first portion and the third portion, wherein the first arcuate channel and the first arcuate passage are concentric with each other about the first diffuser axis, a second diffuser with a second diffuser axis configured to interface with the first diffuser, and an impeller with an impeller axis positioned between the first diffuser and the second diffuser and axially aligned with the first diffuser axis and the second diffuser axis;

the self-priming assembly attached to the plurality of pump stage assemblies and axially aligned with the pump axis, the plurality of pump stage assemblies and the self-priming assembly positioned between the input member and the output member.

12. The multi-stage pump of claim 11, wherein the self-priming assembly is positioned adjacent to the output member.

13. The multi-stage pump of claim 11, wherein the first diffuser and the second diffuser are identical, the second diffuser including a second arcuate channel and a second arcuate passage concentric therewith.

14. The multi-stage pump of claim 13, wherein the first and second arcuate channels of the first and second diffusers, respectively, have a length dimension and the first and second arcuate passages extend laterally along the first and second arcuate channels, respectively, for less than a majority of the length dimension.

15. The multi-stage pump of claim 14, wherein the depth dimension and the width dimension of each of the first and second arcuate channels change over the length dimension.

16. The multi-stage pump of claim 15, wherein the depth dimension and the width dimension of each of the respective first and second arcuate channels increase from the first portion to the second portion and decrease from the second portion to the third portion.

17. The multi-stage pump of claim 11, wherein the impeller has a hub and a plurality of chambers extending outwardly from the hub.

18. The multi-stage pump of claim 17, wherein the plurality of chambers are substantially equally sized and wedge-shaped.

19. The multi-stage pump of claim 18, wherein each chamber of the plurality of chambers extends around the impeller axis approximately $\pi/6$ radians.

* * * * *